US011709029B2

(12) United States Patent
Fife

(10) Patent No.: US 11,709,029 B2
(45) Date of Patent: Jul. 25, 2023

(54) METHOD OF SEAR ENGAGEMENT ADJUSTMENT FOR FIREARMS

(71) Applicant: Kenton Fife, Mantua, UT (US)

(72) Inventor: Kenton Fife, Mantua, UT (US)

(73) Assignee: Kenton Fife, Mantua, UT (US)

( * ) Notice: Subject to any disclaimer, the term of this patent is extended or adjusted under 35 U.S.C. 154(b) by 0 days.

(21) Appl. No.: 17/746,046

(22) Filed: May 17, 2022

(65) Prior Publication Data

US 2022/0373283 A1 Nov. 24, 2022

Related U.S. Application Data

(60) Provisional application No. 63/190,063, filed on May 18, 2021.

(51) Int. Cl.
*F41A 19/12* (2006.01)
*F41A 19/16* (2006.01)

(52) U.S. Cl.
CPC ..... *F41A 19/12* (2013.01); *F41A 19/16* (2013.01)

(58) Field of Classification Search
None
See application file for complete search history.

(56) References Cited

U.S. PATENT DOCUMENTS 4,651,455 A * 3/1987 Geiser, Jr. ..... F41C 33/08 42/70.08

* cited by examiner

*Primary Examiner* — Reginald S Tillman, Jr.

(57) ABSTRACT

A method for sear engagement adjustment of a firearm trigger mechanism by installing a sear control device comprised of a compression spring of a given wire diameter or tube of a given wall thickness over a sear stop pin. The thickness of the sear control device installed over the sear stop pin affects sear engagement. The method for sear engagement adjustment is applied by changing between sear control devices of different thickness until a desired level of sear engagement is achieved.

1 Claim, 3 Drawing Sheets

METHOD OF SEAR ENGAGEMENT ADJUSTMENT FOR FIREARMS

CROSS-REFERENCE TO RELATED APPLICATIONS

Not Applicable

STATEMENT REGARDING FEDERALLY SPONSORED RESEARCH OR DEVELOPMENT (IF APPLICABLE)

Not Applicable

REFERENCE TO SEQUENCE LISTING, A TABLE, OR A COMPUTER PROGRAM LISTING COMPACT DISC APPENDIX (IF APPLICABLE)

Not Applicable

BACKGROUND OF THE INVENTION

This disclosure generally relates to firearm trigger mechanisms.

Mass produced firearms have manufacturing tolerances which are typically biased towards more sear engagement in the trigger mechanism than is necessary for safe and reliable operation. This additional sear engagement increases distance the trigger must travel to release the sear and is usually perceived negatively by the user.

Existing methods for adjustment of sear engagement in firearms trigger mechanisms typically make use set screws or require custom fitting by adding or removing material. Custom fitting is cost prohibitive and timely for mass produced firearms. Set screws methods can have negative effects if they become loose during use. This disclosure allows for an inexpensive, timely, and reliable method of sear engagement adjustment to set sear engagement at a desired level while accounting for the unique tolerances of an individual mass produced firearm.

BRIEF SUMMARY OF THE INVENTION

The present disclosure allows for sear engagement adjustment of a firearm trigger mechanism by installing a sear control device comprised of a compression spring of a given wire diameter or a tube of a given wall thickness over a sear stop pin. The sear stop pin without a sear control device installed governs the maximum amount of sear engagement achievable. Installation of a sear control device over the sear stop pin acts to increase the overall diameter of the sear stop pin in function which reduces sear engagement. Sear engagement is adjusted by changing between sear control devices of different thickness until a desired level of sear engagement is achieved. This method provides a quick, permanent, and inexpensive means of sear adjustment for firearm trigger mechanisms which overcomes the deficiencies of other methods commonly used. This disclosure can be used during production of firearms and is also applicable for use in aftermarket applications for upgrade of existing firearm trigger mechanisms.

DETAILED DESCRIPTION OF THE INVENTION

Figure 1:
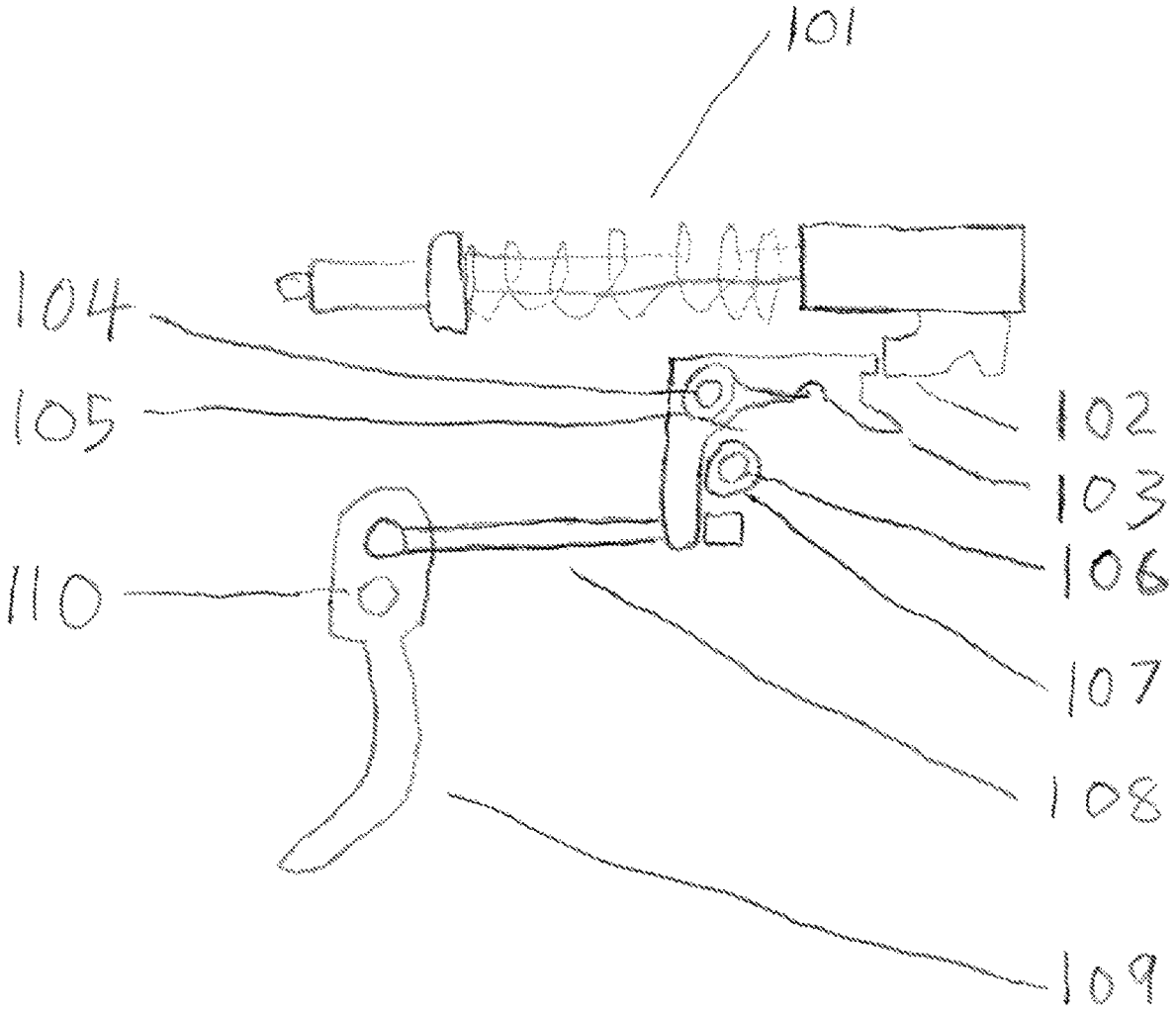
FIG. 1 illustrates an embodiment of the present disclosure to generally show how a sear control device and sear stop pin interact with a representative firearm trigger mechanism to set the level of sear engagement based on the thickness of the sear control device.
Figure 2A:
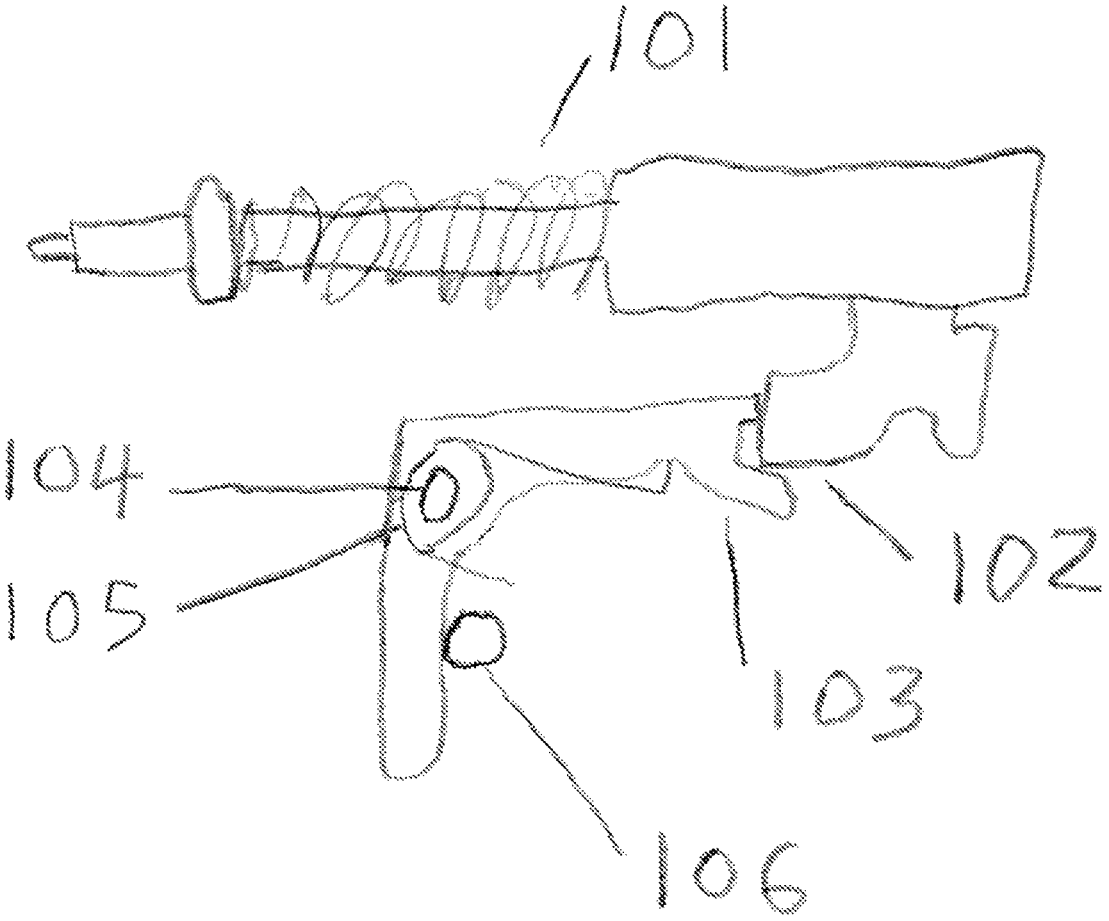
FIG. 2A depicts a sear stop pin in a representative firearm trigger mechanism without a sear control device installed to show the maximum amount of sear engagement achievable.
Figure 2B:
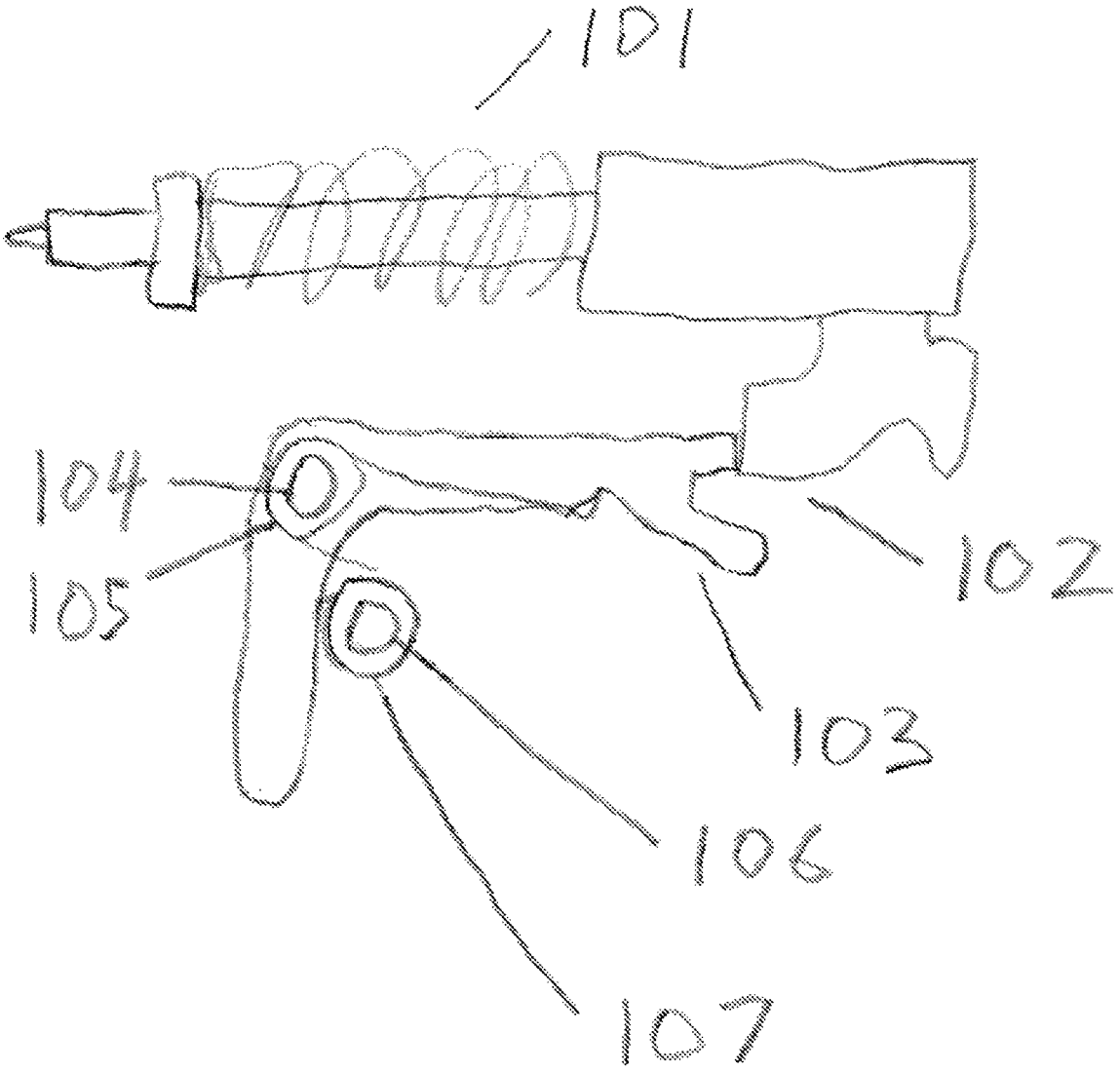
FIG. 2B depicts the representative firearm trigger mechanism of FIG. 2A with a sear control device installed over the sear stop pin to show that reduced sear engagement is achieved in comparison to FIG. 2A.

The striker assembly 101 is the spring loaded device in a firearm trigger control mechanism which is held under tension and once released hits the primer of the ammunition resulting in ignition and firing of the projectile from the firearm, as shown in FIG. 1. The striker assembly 101 is installed in the slide of the firearm and is comprised of a striker, striker spring, striker sleeve, and striker spring cups, as shown if FIG. 1. The striker face 102 is the portion of the striker within the striker assembly 101 which interfaces with the sear 103, as shown in FIG. 1, FIG. 2A, and FIG. 2B. The striker assembly 101 and its associated striker face 102 depicted in FIG. 1, FIG. 2A, and FIG. 2B is representative of various firearm trigger mechanism designs.

The sear 103 is the component of the firearm trigger mechanism that keeps the striker assembly 101 held under tension and releases it once the trigger shoe 109 is pulled rearward, as shown in FIG. 1, FIG. 2A, and FIG. 2B. The sear pin 104 is the hinge point of the sear 103, as shown in FIG. 1, FIG. 2A, and FIG. 2B. The sear spring 105 provides upward pressure on the sear 103 to keep the sear 103 engaged with the striker face 102 when not being moved by the trigger bar 108, as shown in FIG. 1, FIG. 2A, and FIG. 2B. The sear 103 to striker face 102 engagement shown in FIG. 1, FIG. 2A, and FIG. 2B is referred to as sear engagement in this disclosure. The sear 103, sear pin 104, and sear spring 105 depicted in FIG. 1, FIG. 2A, and FIG. 2B are representative of various firearm trigger mechanism designs.

The trigger shoe 109 is the visible portion and user interface of the firearm trigger mechanism, as shown in FIG. 1. The trigger shoe 109 interfaces with the trigger bar 108 to rotate the sear 103 downward to release the striker face 102 as the trigger shoe 109 is pulled rearward, as shown in FIG. 1. The trigger pin 110 is the rotational hinge point for the trigger shoe, as shown in FIG. 1. The trigger shoe 109, trigger pin 110, and trigger bar 108 depicted in FIG. 1 are representative of various firearm trigger mechanism designs.

The sear stop pin 106 is a circular rod or shaft that acts as the stop for the sear 103, as shown in FIG. 1, FIG. 2A, and FIG. 2B. The sear stop pin 106 governs the highest amount of engagement the sear 103 can have with the striker face 102, as shown in FIG. 2A. The sear stop pin 106 can be installed in firearm trigger mechanism designs that do not originally have one or an existing design may already have a pin that can perform this function if not designated as such. For example: the sear stop pin 106 could be designated as a "safety lever pin" but is located sufficiently in the firearm trigger mechanism design to perform the function shown in FIG. 1, FIG. 2A, and FIG. 2B. The sear control device 107 is installed over a sear stop pin 106 to alter the stop point of the sear 103, as shown in FIG. 1 and FIG. 2B. Installation of a sear control device 107 will reduce engagement of the sear 103 to the striker face 102, as shown in FIG. 1 and FIG.

2B when viewed in comparison to without a sear control device 107 installed as shown in FIG. 2A. The thickness of the sear control device 107 will determine the level of sear engagement as shown in FIG. 1 and FIG. 2B.

Key parts of this present disclosure are a sear control device 107 and a sear stop pin 106, as shown in FIG. 1 and FIG. 2B. Installation or use of a sear control device 107 installed over a sear stop pin 106 reduces the amount of sear 103 to striker face 102 engagement (sear engagement) before the trigger shoe 109 is pulled rearward or after the firearm trigger mechanism is in reset as the slide is cycled and the striker face 102 is again held rearward by the sear 103, as shown in FIG. 1 and FIG. 2B. The thickness of a sear control device 107 installed over the sear stop pin 106 governs the level of sear engagement of the firearm trigger mechanism, as shown in FIG. 1 and FIG. 2B. A method of installing sear control devices of different thickness over the sear stop pin can be used to adjust sear engagement into a desire range. A sear control device of a given thickness can be installed and the resulting sear engagement observed. Removal and replacement of a sear control device with another sear control device of different thickness is performed until the desired sear engagement level is achieved. Once the desired sear engagement is achieved with a particular sear control device of appropriate thickness, the final configuration is set. This method is applicable to various firearm trigger mechanism designs that have a pin capable of functioning as sear stop pin 106 or by installing a sear stop pin 106 into the firearm trigger mechanism which is capable of functioning as represented in FIG. 1, FIG. 2A, and FIG. 2B.

An effective implementation of this method is to select or design two or three compression springs with commonly available wire thickness to serve as the sear control devices that can provide sear engagement adjustment to within a desired range for the tolerances of a mass produced firearm. This allows for quick selection of the compression spring that will adjust sear engagement closest to the desired range without need for more than two installations and the majority only requiring a single installation based on known tolerance distributions of the firearm parts.

The invention claimed is:

1. A method of adjusting sear engagement in a firearm having a sear stop pin, the sear stop pin being configured to govern the highest amount of engagement the sear has with a striker face, the method comprising: installing a sear control device over the sear stop pin to reduce the amount of sear to striker face engagement, the sear control device being either at least one tube or at least one compression spring.

* * * * *